US005091632A

United States Patent [19]

Hennecke et al.

[11] Patent Number: 5,091,632

[45] Date of Patent: Feb. 25, 1992

[54] INFRARED RADIATOR

[75] Inventors: Udo Hennecke, Alzenau, Fed. Rep. of Germany; Helmut Wölz, Alpharetta, Ga.

[73] Assignee: Heraeus Quarzglas GmbH, Hanau, Fed. Rep. of Germany

[21] Appl. No.: 610,517

[22] Filed: Nov. 8, 1990

[30] Foreign Application Priority Data

Nov. 20, 1989 [DE] Fed. Rep. of Germany 8913683[U]

[51] Int. Cl.[5] ..... H01C 1/024

[52] U.S. Cl. ..... 219/553; 338/237; 392/407; 313/1

[58] Field of Search ..... 219/461, 462, 463, 464, 219/553; 338/238, 239, 240, 241, 236, 237, 268; 392/407, 424; 313/1, 3, 113, 272, 274, 277, 315, 316, 318; 315/64, 66, 67, 68, 69, 98

[56] References Cited

U.S. PATENT DOCUMENTS

| | | | |
|---|---|---|---|
| 3,071,748 | 1/1963 | Lucia | 338/268 |
| 3,412,276 | 11/1968 | Curl | 313/114 |
| 4,710,676 | 12/1987 | Morris et al. | 313/579 |
| 5,003,284 | 3/1991 | Dieudonné | 338/237 |

FOREIGN PATENT DOCUMENTS

| | | |
|---|---|---|
| 1063725 | 8/1959 | Fed. Rep. of Germany . |
| 1831315 | 5/1961 | Fed. Rep. of Germany . |

OTHER PUBLICATIONS

"Infrarot" by Heraeus Quarzschmetze GmbH, Hanau PIR-B-20, referenced as 2C 4.88/VN Ku.

*Primary Examiner*—Bruce A. Reynolds
*Assistant Examiner*—Michael D. Switzer
*Attorney, Agent, or Firm*—Felfe & Lynch

[57] ABSTRACT

A short-wave infrared radiator includes a longitudinally extended twin tube having two partial chambers running in longitudinal direction. The radiator can optionally be heated over its entire length or a partial length. The radiator is divided into two radiator segments, each having a heater coil and in the vicinity of a partition wall, the heater coils of partial chambers are electrically connected with the heater coils of other partial chambers of the segments. The radiator includes terminals of respective radiator ends to form a power supply and a power return.

7 Claims, 1 Drawing Sheet

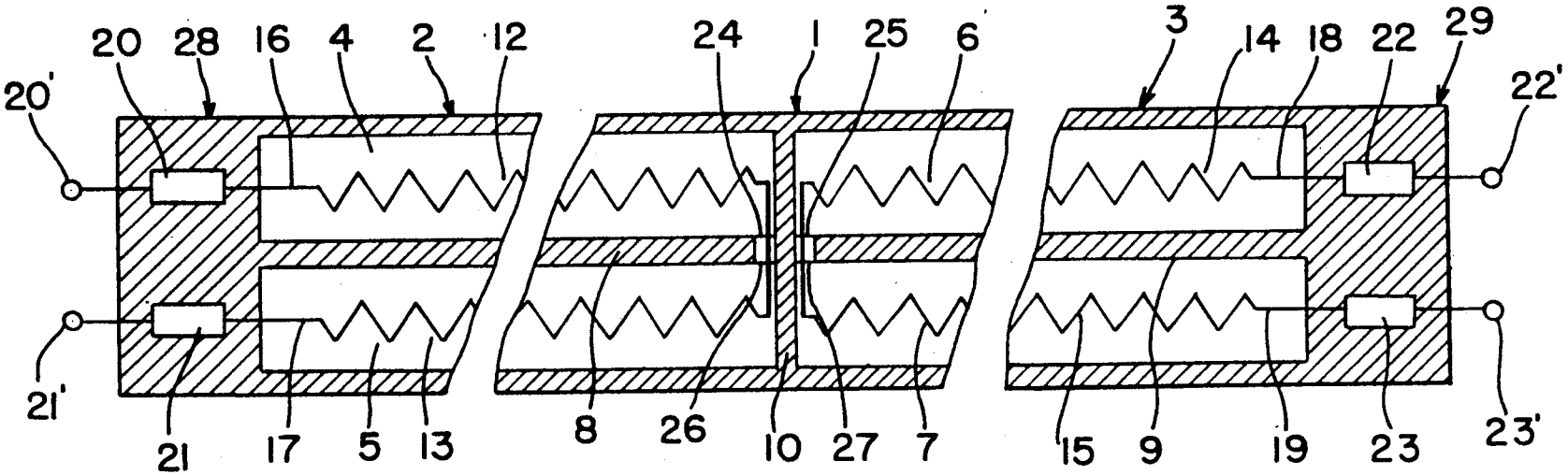
22'
23'
29
22
23
18
19
14
9
3
15
6
7
25
27
1
10
24
26
8
12
13
2
5
4
17
16
28
21
20
20'
21'

INFRARED RADIATOR

The invention relates to a short-wave infrared radiator comprising a longitudinally extended twin tube built as one piece and having an internal spacer which separates two partial chambers in longitudinal direction. Each of the partial chambers accommodates a heater coil. Further, it comprises two power passageways at the ends of the twin tube where they are sealed and led toward the exterior. At the one end of the radiator, the two power passageways are directly connected to the two free ends of the respective heater coils and by way of an external terminal assignment, the radiator can optionally be heated either over its entire length or over a partial length.

The brochure "INFRAROT" referenced as 2C 4.88/VN Ku by Heraeus Quarzschmelze GmbH, Hanau, describes short-wave twin tube infrared radiators which, in a twin tube, have two heater coils each running parallel to the respective tube axis and each contained in a respective partial chamber. These partial chambers are separated by a spacer and run in longitudinal direction. At the end of the twin tube, the heater coils have two sealed power passageways leading to the exterior. Between the terminals, one partial length is formed by the coil and the other partial length is a longitudinally extended power supply without heating properties. Since the coils are displaced with respect to one another, it is possible, by optionally using the first or the second twin tube, to individually operate either the left or right radiator or to illuminate the full length by parallel operation of both coils.

A special field of application of such radiators which can optionally be heated over their entire length or only over a partial length is the drums of printers, particularly laser printers. These laser printers have a heatable drum over which the paper passes that is coated with toner. Since such laser printers have to be built in a very compact way, the dimensions of the individual component parts, i.e. the diameter of the individual drums, are kept small. Consequently, the available space inside the drum to heat up the latter from the inside by means of a radiator is greatly limited. In addition, the lamps must be replaceable due to their limited service life. The lamps are replaced by way of support parts which can be withdrawn from the drum. The available free cross section to insert such a radiator in the drum ranges between 30 to 40 mm. Modern printers are designed such that they can optionally copy various paper formats for which purpose they must switch from one paper size to another. Depending on the paper format, the entire width of the copier may be required and, hence, the entire length of the heating drum must be heated. Smaller paper formats, however, require the heating of only a partial length of the drum. Since copying is usually limited to the formats DIN A3 and DIN A4, the standard format being DIN A4, most of the copies to be made require the heating of only a partial area. This method saves energy and avoids excessive heating of the interior of the apparatus. Switching the apparatus from the smaller DIN A4 format to the larger DIN A3 format requires a quick heating of the entire drum so that a heating radiator with great efficiency is required for such a drum.

Infrared radiators with a twin tube of the aforesaid kind proved well for the heating of such printer drums. In order to use the interior of the drum even more efficiently with known infrared radiators, up to four individual radiators are used each having one single coil. One pair of radiators is used for heating the partial area of the drum whereas the other pair is added to heat up the entire length of the drum. These four individual radiators involve a complex construction.

The twin tubes are operated in a short-wave radiation range. Consequently, they are filled with protective gas and sealed with respect to the exterior. As far as the circuitry is concerned, there are no apparent problems to heat up coils either over only a partial area or over the entire length. The latter, however, requires additional terminals. The installation thereof in a twin tube causes certain problems since it is not possible to freely provide the drawn tube with boreholes. Already in the case of conventional radiators, it is complex to lead the terminals toward the exterior at the crimped ends since such power passageways are limited by their resistance to current and heat.

In other fields of application, for example electrically heated tubular radiators, it has already been proposed to heat either a partial length or the entire length by dividing the heater coil in partial resistances. Such a construction is known, for example, from DE-GM 18 31 315 or DE-AS 10 63 725. An arrangement of this kind, however, requires that the tubular radiator be easily accessible.

Based on the example of an infrared radiator of the aforesaid kind, the invention addresses the task of providing an infrared radiator which can be operated over its entire length or its partial length. In order to optimize power, both coils should always be used.

In a preferred embodiment, the thickness of the partition wall ranges between 2–4 mm; each of the short-circuit bridges contacts the partition wall.

In another preferred embodiment, the total length of the radiator is composed of two radiator segments with a single partition wall. In the area of the partition wall, these segments are mechanically firmly joined to one another by means of their respective front surfaces, the front surfaces of the radiator segments being fused to the partition wall. The electric circuit of the two individual radiators are galvanically separated. The twin tubes are made of quartz glass.

It is, of course, also possible to combine two individual radiators, into one radiator having two radiator segments by fusing or gluing the two front surfaces. In the area of their short-circuit bridges, these radiators are sealed by means of an independent front wall of a small thickness.

The compact construction proved to be advantageous despite the high radiation intensity so that for graphic purposes, for example, the radiators can be included in the interior of rotating drums. Due to external circuit elements, it is possible to achieve a uniform intensity density covering the full length or the partial length so that when the device is used in graphic apparatus, there is a uniform exposition over the entire picture area. Since the two radiator segments are joined via only a small area of the partition wall, the resulting unheated area is also consequently small.

In accordance with the invention, a short-wave infrared radiator comprises a longitudinally extended twin tube having an internal spacer which separates two partial chambers running in longitudinal direction. Each of these chambers accommodates a heater coil. The tube includes sealed power passageways led toward the exterior at the ends of the twin tube. These power passageways, at one end of the radiator, are directly connected to two free ends of the respectively associated heater coils. By means of an external terminal assignment, the radiator can be optionally heated over its entire length or a partial length. Over its length, the radiator is divided in two radiator segments and at least one partition wall for separating the segments. The segments each have a heater coil in the respective partial chambers and, in the vicinity of the partition wall, the heater coils of partial chambers are electrically connected with the heater coils of other partial chambers of the segments. The radiator includes terminals of respective radiator ends to form a power supply and a power return.

For a better understanding of the invention, together with other and further objects thereof, reference is made to the following description, taken in connection with the accompanying drawing, and its scope will be pointed out in the appended claims.

Referring now to the drawing:

The Figure is a cross section of an infrared radiator in accordance with the invention.

Due to the relatively large ratio of length to width, the radiator, for a better understanding, is represented as one continuous piece but in three partial segments.

The radiator 1 preferably comprises two radiator segments 2, 3 in the form of individual radiators with twin tubes where two tubular partial segments 4, 5 and 6, 7, at a time, are separated by a spacer 8, 9. Both individual radiators, formed by segments 2, 3, are axially connected via their partition wall 10 such that the axes of the twin tubes also run axially to each other. Each end of the two radiator segments 2, 3 located in the center of the radiator is joined to one side of the discoidal partition wall 10 by means of a fused connection. Those parts of the spacers 8, 9 which are adjacent to the partition wall 10 have an indentation 26, 27 for the passage of the short-circuit bridges 24, 25 in direct vicinity of the partition wall 10. The short circuit bridges 24, 25 can be form-fittingly supported by the indentation 26, 27 of the spacers 8, 9. In each of the partial chambers 4, 5 or 6, 7, there are heater coils 12, 13 and 14, 15 parallel to the tube axis. The free ends 16, 17 and 18, 19 thereof are connected to power passageways 20, 21 and 22, 23 which are sealed with respect to the exterior in that the radiator ends 28, 29 are crimped. Each of the heater coils 12, 14 of the respective partial chamber 4, 6 is connected to the heater coils 13, 15 of the other partial chamber 5, 7 by means of a short-circuit bridge 24, 25, respectively. In order to seal the partial chambers 4, 5 and 6, 7 which are filled with protective gas, the power passageways 20, 21 and 22, 23 are led over molybdenum films sealed in the tube material of the radiator ends 28, 29. A gas filling that proved to operate particularly well was argon. The partition wall preferably has a thickness of approximately 1.5 mm.

In the subsequently explained possible ways of connection, the individual radiators 2, 3, can be connected by means of their terminals 20', 21', and 22', 23' to either a direct current source or an alternate current source. The radiator can be operated over its full length by parallel operation of both individual radiators at one common voltage source, for example, by switching parallel the terminals 20' and 22', and 21' and 23' to respective terminals of the voltage source. During operation at partial length, only the terminals 20', 21' or 22', 23' are connected to a voltage source.

The twin tubes preferably are manufactured by long drawing from quartz glass. The respective radiator ends 28, 29 are provided with power passageways 20, 21, 22, 23 with molybdenum films which are contacted, on the one side, with the free ends 16, 17, 18, 19 of the heater coils 12, 13, 14, 15 and, on the other side, with contact wires leading to the terminals 20', 21', 22', 23' which serve as external contacts. The actual sealing is done by means of crimping as it is conventionally done in metal vapor-discharge lamp technology.

For the use in a printer drum, for example a laser printer, the length of a stationary radiator is approximately 800 mm whereas height and width amount to approximately 20 and 30 mm. The power obtained when operating at full length is at 6 kW.

The protective gas atmosphere is provided according to methods conventionally used in metal vapor - discharge lamps.

While there has been described what is at present considered to be the preferred embodiment of this invention, it will be obvious to those skilled in the art that various changes and modifications may be made therein without departing from the invention, and it is, therefore, aimed to cover all such changes and modifications as fall within the true spirit and scope of the invention.

We claim:

1. Short-wave infrared radiator comprising: a longitudinally extended twin tube having an internal spacer which separates two partial chambers running in longitudinal direction, each of these chambers accommodating a heater coil, and the tube including sealed power passageways led toward the exterior at the ends of the twin tube, these power passageways, at one end of the radiator, being directly connected to two free ends of the respectively associated heater coils, and, by means of an external terminal assignment, the radiator being optionally heated over its entire length or a partial length, over its length, the radiator 1 being divided in two radiator segments 2, 3 and at least one partition wall for separating the segments 2, 3, the segments 2, 3 each having a heater coil 12, 13, 14, 15 in the respective partial chambers 4, 5, 6, 7, and, in the vicinity of the partition wall, the heater coils 12, 14 of partial chambers 4, 6 being electrically connected with the heater coils 13, 15 of other partial chambers 5, 7 of the same segments, and the radiator including terminals of respective radiator ends 28, 29 to form a power supply 20, 22 and a power return 21, 23.

2. Short-wave infrared radiator in accordance with claim 1, in which the thickness of the partition wall 10 ranges between 1 to 4 mm.

3. Short-wave infrared radiator in accordance with claim 1, which includes short-circuit bridges 24, 25 electrically connecting the heater coils 12, 14 of partial chambers 4, 6 with the heater coils of other partial chamber 5, 7 of the same segments; said short-circuit bridges 24, 25 each contacting the partition wall 10.

4. Radiator in accordance with claim 1, in which the total length of the radiator is composed of two individual radiators corresponding to the radiator segments 2, 3, these individual radiators, which serve as partition walls, being mechanically firmly joined to on another.

5. Radiator in accordance with claim 4, in which the two individual radiators are fused to each other in the area of the partition walls.

6. Radiator in accordance with claim 4, in which the circuits of both individual radiators are electrically separated from each other.

7. Radiator in accordance with claim 1, in which the twin tubes are made of quartz glass.

* * * * *

UNITED STATES PATENT AND TRADEMARK OFFICE

CERTIFICATE OF CORRECTION

PATENT NO. : 5,091,632

DATED : February 25, 1992

INVENTOR(S) : Udo Hennecke et al

It is certified that error appears in the above-indentified patent and that said Letters Patent is hereby corrected as shown below:

Column 4, line 36 delete "1".

Column 4, line 37 delete "2, 3".

Column 4, line 38 delete "2, 3" (both occurrences).

Column 4, line 39 delete "12, 13, 14, 15".

Column 4, line 40 delete "4, 5, 6, 7,".

Column 4, line 42 delete "4, 6".

Column 4, line 43 delete "13, 15".

Column 4, line 43 delete "5, 7".

Column 4, line 45 delete "28, 29".

Column 4, line 45 delete "20, 22".

Column 4, line 46 delete "21, 23".

Column 4, line 48 delete "10".

Column 4, line 51 delete "24, 25".

Column 4, line 52 delete "12, 14".

UNITED STATES PATENT AND TRADEMARK OFFICE

CERTIFICATE OF CORRECTION

PATENT NO. : 5,091,632

DATED : February 25, 1992

INVENTOR(S) : Udo Hennecke et al

It is certified that error appears in the above-indentified patent and that said Letters Patent is hereby corrected as shown below:

Column 4, line 53 delete "4, 6".

Column 4, line 54 delete "5, 7".

Column 4, line 55 delete "24, 25".

Column 4, line 55 delete "10".

Column 4, lines 58-59 delete "2, 3".

Signed and Sealed this

Eleventh Day of October, 1994

*Attest:*

Bruce Lehman

BRUCE LEHMAN

*Attesting Officer*

*Commissioner of Patents and Trademarks*